US006109538A

United States Patent [19]

Villani et al.

[11] Patent Number: 6,109,538

[45] Date of Patent: Aug. 29, 2000

[54] FLAVORING DELIVERY DRINKING STRAW

[76] Inventors: Michael S. Villani; Anthony Raponi, both of 146 Melville Road Pascoe Vale South, Melbourne, Victoria 3044, Australia

[21] Appl. No.: 09/252,113

[22] Filed: Feb. 18, 1999

[51] Int. Cl.[7] ..... A47G 21/18

[52] U.S. Cl. ..... 239/33; 239/310; D7/300.2

[58] Field of Search ..... 239/16, 24, 33, 239/310, 315, 316, 590; D7/300.2; 604/48, 77, 78, 82, 83, 84; 426/85, 96; 424/468

[56] References Cited

U.S. PATENT DOCUMENTS

| | | | |
|---|---|---|---|
| D. 332,198 | 1/1993 | Goodman, Jr. | D7/300.2 |
| 2,867,536 | 1/1959 | Mead et al. | 239/33 |
| 3,409,224 | 11/1968 | Harp et al. | 239/33 |
| 3,615,595 | 10/1971 | Guttag | 239/33 |
| 3,620,770 | 11/1971 | Harvey | 239/33 |
| 4,921,713 | 5/1990 | Fowler | 426/85 |
| 5,094,861 | 3/1992 | D'Auguste | 426/85 |

*Primary Examiner*—Andres Kashnikow
*Assistant Examiner*—Lisa Ann Douglas

[57] ABSTRACT

A flavoring delivery drinking straw for adding a flavoring to a liquid passing through the drinking straw. The flavoring delivery drinking straw includes an elongate tube with spaced apart pair of screens disposed in the lumen of the tube to block passage of objects greater than a predetermined size through the lumen of the tube. A flavoring object is disposed in the lumen of the tube between the screens for imparting a flavor to a liquid passing through the lumen of the tube.

7 Claims, 1 Drawing Sheet

FLAVORING DELIVERY DRINKING STRAW

BACKGROUND OF THE INVENTION

1. Field of the Invention

The present invention relates to flavored drinking straws and more particularly pertains to a new flavoring delivery drinking straw for adding a flavoring to a liquid passing through the drinking straw.

2. Description of the Prior Art

The use of flavored drinking straws is known in the prior art. More specifically, flavored drinking straws heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,094,861 by D'Auguste et al.; U.S. Pat. No. 2,867,536 by Mead et al.; U.S. Pat. No. 3,620,770 by Harvey; U.S. Pat. No. 3,615,595 by Guttag; U.S. Pat. No. 4,921,713 by Folwer; and U.S. Pat. No. Des. 332,198 by Goodman Jr.

While these devices fulfill their respective, particular objectives and requirements, the aforementioned patents do not disclose a new flavoring delivery drinking straw. The inventive device includes an elongate tube with spaced apart pair of screens disposed in the lumen of the tube to block passage of objects greater than a predetermined size through the lumen of the tube. A flavoring object is disposed in the lumen of the tube between the screens for imparting a flavor to a liquid passing through the lumen of the tube.

In these respects, the flavoring delivery drinking straw according to the present invention substantially departs from the conventional concepts and designs of the prior art, and in so doing provides an apparatus primarily developed for the purpose of adding a flavoring to a liquid passing through the drinking straw.

SUMMARY OF THE INVENTION

In view of the foregoing disadvantages inherent in the known types of flavored drinking straws now present in the prior art, the present invention provides a new flavoring delivery drinking straw construction wherein the same can be utilized for adding a flavoring to a liquid passing through the drinking straw.

The general purpose of the present invention, which will be described subsequently in greater detail, is to provide a new flavoring delivery drinking straw apparatus and method which has many of the advantages of the flavored drinking straws mentioned heretofore and many novel features that result in a new flavoring delivery drinking straw which is not anticipated, rendered obvious, suggested, or even implied by any of the prior art flavored drinking straws, either alone or in any combination thereof.

To attain this, the present invention generally comprises an elongate tube with spaced apart pair of screens disposed in the lumen of the tube to block passage of objects greater than a predetermined size through the lumen of the tube. A flavoring object is disposed in the lumen of the tube between the screens for imparting a flavor to a liquid passing through the lumen of the tube.

There has thus been outlined, rather broadly, the more important features of the invention in order that the detailed description thereof that follows may be better understood, and in order that the present contribution to the art may be better appreciated. There arc additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new flavoring delivery drinking straw apparatus and method which has many of the advantages of the flavored drinking straws mentioned heretofore and many novel features that result in a new flavoring delivery drinking straw which is not anticipated, rendered obvious, suggested, or even implied by any of the prior art flavored drinking straws, either alone or in any combination thereof.

It is another object of the present invention to provide a new flavoring delivery drinking straw which may be easily and efficiently manufactured and marketed.

It is a further object of the present invention to provide a new flavoring delivery drinking straw which is of a durable and reliable construction.

An even further object of the present invention is to provide a new flavoring delivery drinking straw which is susceptible of a low cost of manufacture with regard to both materials and labor, and which accordingly is then susceptible of low prices of sale to the consuming public, thereby making such flavoring delivery drinking straw economically available to the buying public.

Still yet another object of the present invention is to provide a new flavoring delivery drinking straw which provides in the apparatuses and methods of the prior art some of the advantages thereof, while simultaneously overcoming some of the disadvantages normally associated therewith.

Still another object of the present invention is to provide a new flavoring delivery drinking straw for adding a flavoring to a liquid passing through the drinking straw.

Yet another object of the present invention is to provide a new flavoring delivery drinking straw which includes an elongate tube with spaced apart pair of screens disposed in the lumen of the tube to block passage of objects greater than a predetermined size through the lumen of the tube. A flavoring object is disposed in the lumen of the tube between the screens for imparting a flavor to a liquid passing through the lumen of the tube.

Still yet another object of the present invention is to provide a new flavoring delivery drinking straw that is especially useful for adding a flavoring to milk passing through the drinking straw so that a drinker may experience a unique flavor when drinking milk.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
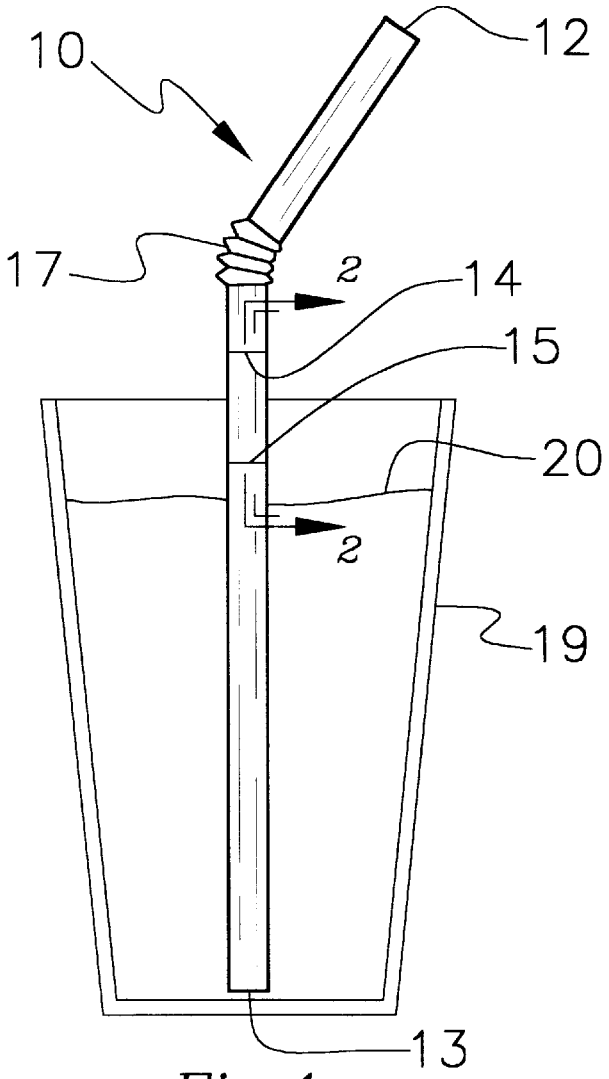
FIG. 1 is a schematic side view of a new flavoring delivery drinking straw in a container with a liquid beverage according to the present invention.
Figure 2:
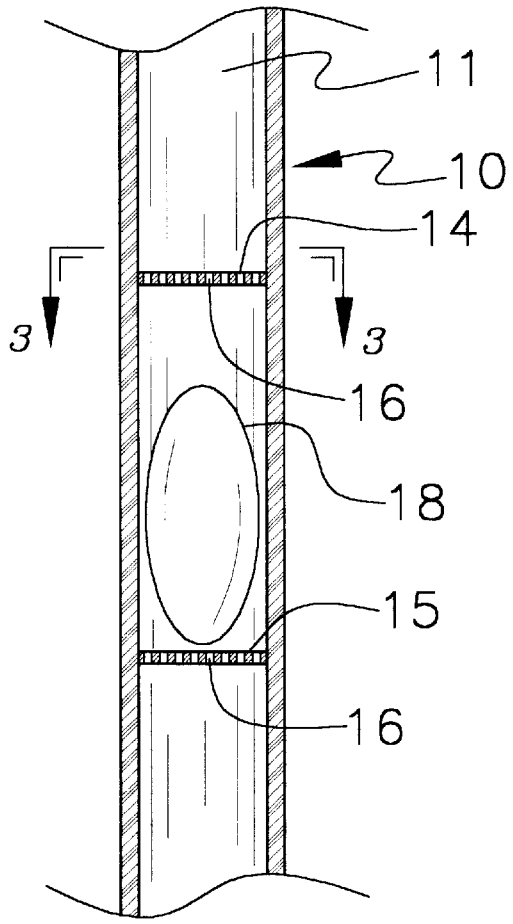
FIG. 2 is a schematic cross sectional view of the present invention taken from line 2—2 of FIG. 1.
Figure 3:
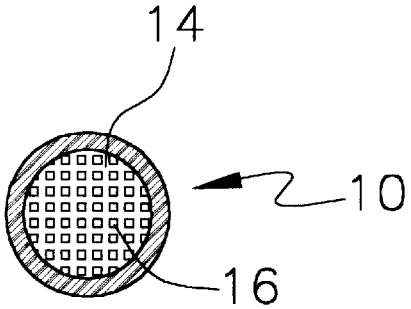
FIG. 3 is a schematic cross sectional view of the present invention taken from line 3—3 of FIG. 2.

With reference now to the drawings, and in particular to FIGS. 1 through 3 thereof, a new flavoring delivery drinking straw embodying the principles and concepts of the present invention will be described.

As best illustrated in FIGS. 1 through 3, the flavoring delivery drinking straw generally comprises an elongate tube with spaced apart pair of screens disposed in the lumen of the tube to block passage of objects greater than a predetermined size through the lumen of the tube. A flavoring object is disposed in the lumen of the tube between the screens for imparting a flavor to a liquid passing through the lumen of the tube.

In closer detail, the drinking straw comprises an elongate tube 10 with has a lumen 11, a pair of opposite open ends 12,13 into the lumen, and a longitudinal axis extending between the ends of the tube. The tube typically has a generally circular transverse cross section taken substantially perpendicular to the longitudinal axis of the tube although the transverse cross section may also be any other shape such as square or hexagonal.

As best illustrated in FIG. 2, a spaced apart pair of screens 14,15 are disposed in the lumen of the tube to block passage of objects greater than a predetermined size through the lumen of the tube. The screens may comprise mesh screens or disks with apertures or perforations therethrough. In the disk embodiment of the screens, apertures 16 of each disk are preferably arranged in a rectangular grid like fashion with the apertures spaced apart at generally equal intervals on the respective disk as illustrated in FIG. 3.

In an optional ideal embodiment, the tube has a bendable region 17 between the ends of the tube dividing the tube into a pair of elongate portions. As shown in FIG. 1, the bendable region comprises a plurality of annular accordion-like pleats that permit bending of the tube in the bendable region. The bendable region is located closer to a first of the ends 12 of the tube than to a second of the ends 13 of the tube. Preferably, the screens arc positioned adjacent the bendable region between the bendable region and the second end of the tube.

With reference to FIG. 2, a flavoring object 18 is disposed in the lumen of the tube between the screens. The flavoring object is designed for delivering or imparting a flavor to a liquid passing through the lumen of the tube. Ideally, the flavoring object comprises a pellet or tablet of particulate flavoring capable of being dissolved in liquid such that the liquid takes on the flavor of the flavoring of the flavoring object.

The flavoring object preferably has a size greater than the predetermined size of the apertures or openings of the screens such that the flavoring object is blocked from passing through the screens. Preferably, the object has a generally oval or egg-shaped configuration with an outer diameter defined transversely from the longitudinal axis of the tube less than the diameter of the lumen also defined transversely to the longitudinal axis of the tube so that liquid passing through the lumen may pass around the flavoring object. Also preferably, the flavoring object has a length defined along the longitudinal axis of the tube which is less than the distance between the disks such that the flavoring object is free to move between the screens as liquid is passed through the lumen to help add a little agitation to help increase the amount of flavoring imparted to the liquid by the flavoring object. Ideally, the length of the flavoring object is less than about three-quarters the distance between the screens.

In use, a user places the drinking straw in a container 19 with a liquid 20 or beverage such as milk and draws liquid through the straw to drink the beverage. As the liquid passes through the straw it passes through the screens and past the flavoring object so that the flavoring in the flavoring object is imparted or dissolved into the passing liquid so that the user may taste the flavoring in the drawn liquid.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A drinking straw, comprising:

an elongate tube having a lumen, a pair of opposite open ends;

a spaced apart pair of screens being disposed in said lumen of said tube, said screens blocking passage of objects greater than a predetermined size through said lumen of said tube; and a flavoring object being disposed in said lumen of said tube between said screens, said flavoring object being adapted for delivering a flavor to a liquid passing through said lumen of said tube; and wherein said tube has a bendable region between said ends of said tube dividing said tube into a pair of elongate portions, wherein said bendable region is located closer to a first of said ends of said tube than to a second of said ends of said tube, and wherein said screens are positioned adjacent said bendable region between said bendable region and said second end of said tube.

2. The drinking straw of claim 1, wherein said tube has a longitudinal axis extending between said ends of said tube, wherein said tube has a generally circular transverse cross section taken substantially perpendicular to said longitudinal axis of said tube.

3. The drinking straw of claim 1, wherein said bendable region comprises a plurality of annular accordion-like pleats permitting bending of said tube in said bendable region.

4. The drinking straw of claim 1, wherein said flavoring object having a size greater than a predetermined size of openings in said screens such that said flavoring object is blocked from passing through said screens.

5. The drinking straw of claim 1, wherein said flavoring object has a length defined along a longitudinal axis of said tube, said length of said flavoring object being less than the distance between said screens.

6. The drinking straw of claim 5, wherein said length of said flavoring object is less than about three-quarters the distance between said screens.

7. A drinking straw, comprising:

an elongate tube having a lumen, a pair of opposite open ends, and a longitudinal axis extending between said ends of said tube;

said tube having a generally circular transverse cross section taken substantially perpendicular to said longitudinal axis of said tube;

a spaced apart pair of screens being disposed in said lumen of said tube, said screens blocking passage of objects greater than a predetermined size through said lumen of said tube;

said tube having a bendable region between said ends of said tube dividing said tube into a pair of elongate portions, said bendable region comprising a plurality of annular accordion-like pleats permitting bending of said tube in said bendable region;

said bendable region being located closer to a first of said ends of said tube than to a second of said ends of said tube;

said screens being positioned adjacent said bendable region between said bendable region and said second end of said tube;

a flavoring object being disposed in said lumen of said tube between said screens, said flavoring object being adapted for delivering a flavor to a liquid passing through said lumen of said tube;

said flavoring object having a size greater than a predetermined size of openings in said screens such that said flavoring object is blocked from passing through said screens;

wherein said flavoring object having a length defined along said longitudinal axis of said tube, said length of said flavoring object being less than the distance between said disks; and wherein said length of said flavoring object is less than about three-quarters the distance between said screens.

* * * * *